United States Patent [19]

Diakonov

[11] 4,285,124

[45] Aug. 25, 1981

[54] SAFETY RAZOR FOR TRIMMING BEARDS AND MUSTACHES

[76] Inventor: Yuri G. Diakonov, 36024 St. Ives Ct., Fraser, Mich. 48026

[21] Appl. No.: 77,572

[22] Filed: Sep. 21, 1979

[51] Int. Cl.[3] ..... B26B 21/06

[52] U.S. Cl. ..... 30/34.1; 30/50; 30/32

[58] Field of Search ..... 30/29.5, 32, 34.1, 47, 30/50, 86

[56] References Cited

U.S. PATENT DOCUMENTS

| | | | |
|---|---|---|---|
| 2,306,890 | 12/1942 | Mayeux | 30/32 X |
| 2,764,811 | 10/1956 | Guardino | 30/29.5 |
| 3,383,764 | 5/1968 | Sachs | 30/32 |
| 3,409,982 | 12/1968 | Baker | 30/47 |
| 3,967,372 | 7/1976 | Beck | 30/34.1 |

*Primary Examiner*—Gary L. Smith

*Attorney, Agent, or Firm*—Basile, Weintraub & Hanlon

[57] ABSTRACT

A safety razor for trimming beards and mustaches around their edges is disclosed. The present invention comprises a razor blade, a head for holding the razor blade, and a blade support all having complementary tapered ends which taper from an edge opposite the cutting edge to a point just above the end of the cutting edge. The tapered ends permit the user of the safety razor to trim his beard or mustache beneath his nostrils. The present invention optionally includes a retractable miniature safety razor which is movable from a first position where it is retracted behind the head to a second position where it is deployed above the head for use in trimming the area beneath the center of the user's nose.

5 Claims, 5 Drawing Figures

SAFETY RAZOR FOR TRIMMING BEARDS AND MUSTACHES

BACKGROUND OF THE INVENTION

I. Field of the Invention

The present invention relates to the field of safety razors. More specifically, the present invention relates to the field of safety razors for trimming beards and mustaches. Even more specifically the present invention relates to the field of safety razors for trimming beards and mustaches wherein the ends of the blade are tapered providing a narrow portion for shaving and trimming beneath the user's nostrils. Additionally the present invention relates to the field of safety razors for trimming beards and mustaches wherein a second retractable miniature razor is provided for shaving directly beneath the nose of the user.

II. Description of the Prior Art

Safety razors are known as well as retractable safety razors. Safety razors having a slightly angled end are also known. However, the angled ends of known razors are minor in nature and the angle is employed for the purpose of preventing corner clash when the razor is pivoted or deployed from one position to another.

U.S. Pat. No. 1,767,706 discloses a safety razor with angled ends. The purpose of the angle is to provide corner clearance for the edge of the blade opposite the cutting edge as it is rotated from a horizontal position to a vertical position, thus avoiding interference with the blade support.

U.S. Pat. No. 1,844,318 discloses a safety razor with a blade holder having angled ends. The angling of the ends in this patent is slight and has the purpose of providing corner clearance for the edge opposite the cutting edge when the blade holder and blade are rotated from a horizontal to a vertical position.

U.S. Pat. No. 1,825,429 discloses a retractable safety razor which retracts into a magazine.

U.S. Pat. No. 2,510,951 discloses a magazine safety razor with a head which is joined to a handle by a ball and socket joint allowing the head to be pivoted with respect to the handle.

None of the above listed United States Patents disclose the present invention of a safety razor with tapered ends, the taper beginning proximate a center of the blade and terminating at the end of the cutting edge at a point spaced above the cutting edge. None of the above listed United States Patents disclose a miniature razor supported by a razor handle with tapered ends, the miniature razor being movable between a retracted position and a deployed position.

The above listed United States Patents constitute the entire art known to the Applicant and his Attorney which comes closest to the disclosure of the present invention.

SUMMARY OF THE INVENTION

It is an object of the present invention to provide a safety razor with thin tapered ends which may be employed to trim a beard or mustache beneath the user's nostrils. It is also an object of the present invention to provide a safety razor with thin tapered ends which also includes a retractable miniature safety razor which may be employed to trim a beard or mustache in confined places such as directly under the center of the user's nose.

It is a further object of the present invention to provide a safety razor with thin tapered ends for trimming the beard or mustache of the user wherein the safety razor has a disposable head.

It is also an object of the present invention to provide a safety razor with thin tapered ends for trimming beards or mustaches wherein the entire razor is disposable after the blade becomes dull.

The present invention comprises a safety razor for trimming beards and mustaches having a head, blade, and blade support with complementary tapered ends extending from an upper edge proximate a center of the head to a point proximate the cutting edge at an end thereof. The thin tapered ends of the head and blade allow the user of the safety razor to trim an upper edge of a beard or mustache beneath the user's nostrils.

The present invention comprises a two-thirds normal size safety razor including a normal sized handle for shaving an edge of beards and mustaches which comprises a pair of plastic blade supporting bodies including an elongated member with a planar face engaging wall disposed at a downward angle to an axis of the handle. A bottom wall of the member begins at a lower edge of the face engaging wall and extends upward and inward toward the handle to a point vertically under an upper edge of the face engaging wall. A rear wall extends upward vertically from a rear edge of the bottom wall and is spaced from the axis of the handle a distance to meet an upper edge of the face engaging wall. The member has a vertical end wall defining one end of the member and a slanted end wall slanting from a point along the upper edge spaced from a center of the member to the lower edge defining a thin tapered end wall of the member.

A blade is imbedded in the body with a cutting edge projecting from the face engaging wall and extending outward and downward a distance. The blade is spaced a slight distance above and parallel to the lower edge of the face engaging wall and extending longitudinally to a point short of the end walls.

A downward extending collar is integral with and supports the members in a spaced apart manner to define a longitudinal channel between the rear walls. A threaded aperture formed in a lower end of the collar is concentric with a through opening communicating with the longitudinal channel.

The handle includes a threaded end which threadingly engages the threaded aperture to secure the downward extending collar. The collar is disengaged from the handle to replace dull blades with new ones.

A retractable miniature razor is provided which is movable from a first position where it is retracted between the members to a second position where it is deployed above the members for use.

For a more complete understanding of the present invention, reference is made to the following detailed description and accompanying drawing.

Other objects, advantages, and applications of the present invention will become apparent to those skilled in the field to which this invention pertains, when the accompanying description of the best modes contemplated for practicing the invention are read in conjunction with the accompanying drawing.

BRIEF DESCRIPTION OF THE DRAWING

In the drawing, like reference numbers refer to like parts throughout the several views, and wherein.

DESCRIPTION OF THE PREFERRED EMBODIMENT

Figure 1:
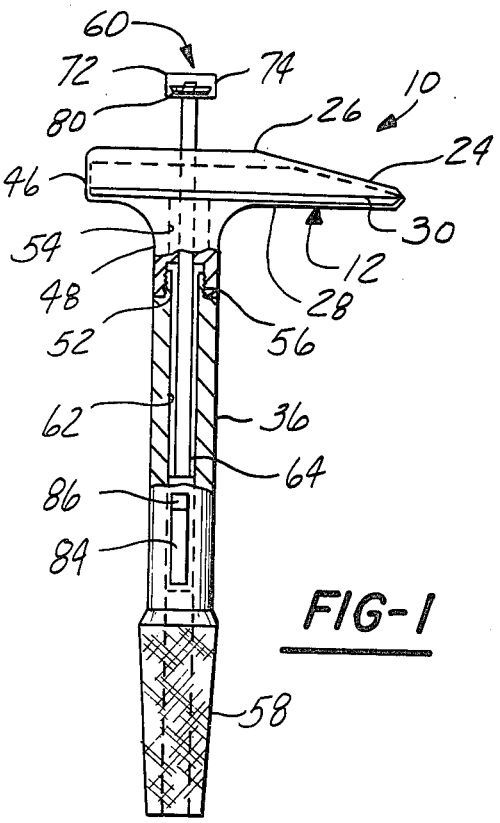
FIG. 1 illustrates a partially sectioned front view of a preferred embodiment of the present invention.
Figure 2:
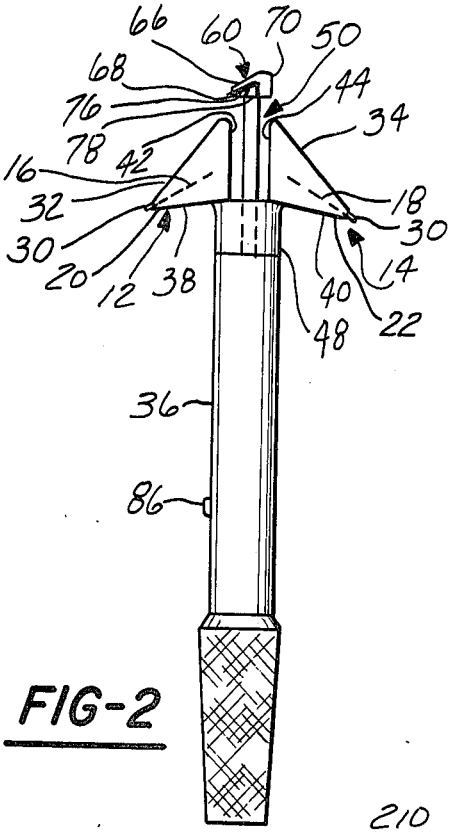
FIG. 2 illustrates a side view of the razor of FIG. 1.

Referring now to the drawing and in particular to FIGS. 1 and 2 wherein there is illustrated at 10 a preferred embodiment of the present invention. The preferred embodiment 10 comprises a two-third normal size safety razor having a pair of opposed complementary heads 12,14 which support a pair of blades 16,18 in a pair of opposed blade supports 20,22. Each of the opposed heads 12,14, the opposed blades 16,18 and the blade supports 20,22 include a thin tapered end 24 which extends from an upper edge 26 to a point proximate a lower edge 28. A cutting edge 30 of the blades 16,18 projects from the opposed heads 12,14 along a line parallel to and proximate the lower edge 28 and is spaced a slight distance thereabove. The cutting edge 30 extends longitudinally to a point close to but short of the ends 24.

In a preferred embodiment as illustrated in FIGS. 1 and 2 the pair of opposed blade supports 20,22 are made of plastic comprising elongated members with planar face engaging walls 32,34 extending downward and outward at a angle to an axis of a normal size handle 36. Bottom walls 38,40 of the members begin at a lower edge of the face engaging walls and extend upward and inward toward the handle. Rear walls 42,44 extend upward from a rear edge of the bottom walls and are spaced from the axis of the handle a distance to meet the upper edge 26 of the face engaging wall enclosing the member. The vertical end wall 46 defines one end of the member, and the thin tapered end 24 defines the other end of the member.

The blades 16,18 are imbedded in the plastic of the member with the cutting edge 30 extending outward and downward from the face engaging walls 32,34. The blade cutting edge 30 extends longitudinally parallel to the lower edge 28 and is spaced slightly above the lower edge to a point short of the thin tapered ends, and to a point short of the vertical end wall.

A downward projecting collar 48 is formed integral with the members supporting them in a spaced apart manner to define a longitudinal channel 50 between the rear walls 42,44. A threaded aperture 52 formed in a lower end of the collar 48 is concentric with a through opening 54 which extends upward to communicate with the longitudinal channel 50.

The handle 36 has a threaded portion 56 formed at an upper end thereof to threadingly engage the threaded aperture 52. A lower end 58 of the handle is enlarged and roughened to provide a comfortable grip for the user of the device.

In an alternate embodiment of the safety razor (FIGS. 1 and 2) a retractable miniature razor 60 is provided which is movable from a first position wherein the miniature razor 60 is retracted into the channel 50 to a second position wherein the miniature razor 60 is deployed above the blade supports 20,22 where it may be employed to trim whiskers in hard to get at areas such as those under the nose of the user. The miniature razor 60 is supported by a central bore 62 formed in the handle 36. A rod 64 slidingly engages the bore 62 and extends upward to support the miniature razor 60 at an upper end thereof.

The miniature razor 60 includes a miniature face engaging wall 66 which extends downward and outward from the rod 64. A bottom wall 68 of the miniature razor extends from a bottom edge of the wall 66 perpendicular to the rod 64, and a rear wall 70 extends between the bottom wall and a top edge of the miniature face engaging wall 66 enclosing the structure. A pair of end walls 72,74 define the ends of the miniature razor. A threaded aperture 76 formed in the bottom wall threadingly engages a threaded end 78 of the rod 64 to support the razor 60.

A miniature blade 80 is imbedded in a body of the miniature razor 60 with a cutting edge projecting from the miniature face engaging wall 66 along a lower edge thereof.

A slot 84 is formed longitudinally along the handle communicating with the bore 62. A projection 86 is formed on the rod and aligned with the slot to be slidingly movable therealong. Movement of the projection 86 within the slot 84 defines the first and second positions for the miniature razor 60.

In the preferred embodiment 10 the opposed heads 12,14 may be selectively replaced when the blades become dull by threadingly disengaging the collar 48 from the thread 56 and threading on a replacement pair of heads. Also the miniature razor 60 may be replaced by threadingly disengaging the miniature razor from the rod and threading on a replacement miniature razor.

Figure 3:
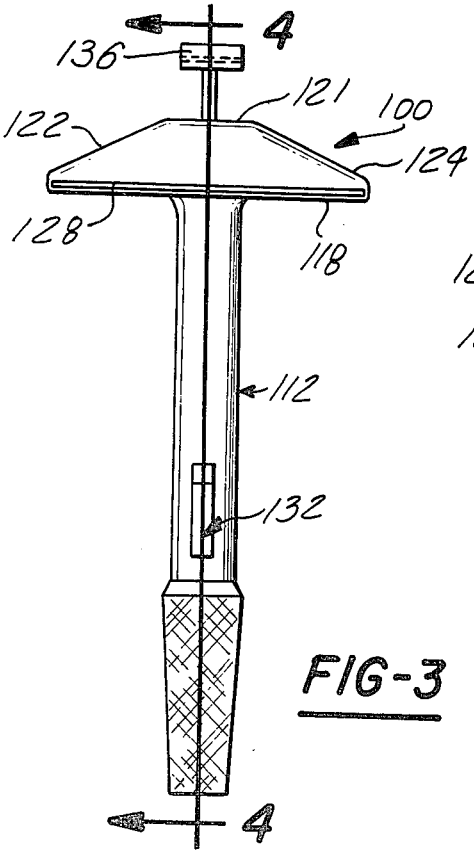
FIG. 3 illustrates a front view of a second embodiment of the present invention.
Figure 4:
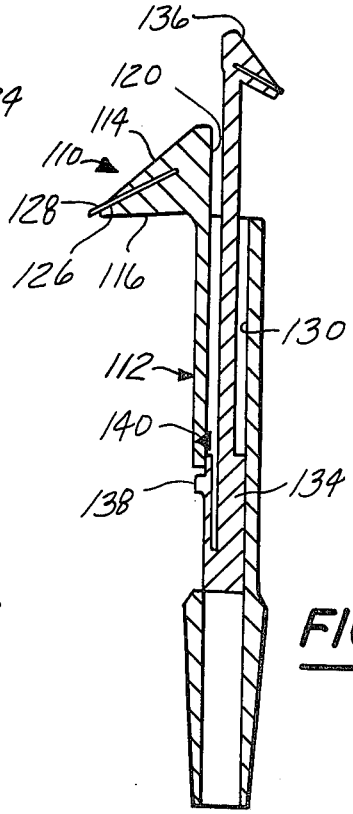
FIG. 4 illustrates a cross sectional view of the razor of FIG. 3 taken along the line 4—4 of FIG. 3.

Referring again to the drawing, and in particular to FIGS. 3–4 wherein there is illustrated an inexpensive throw away embodiment of the present invention. A two-third size safety razor and normal size handle 100 for shaving an edge of beards and mustaches comprises a blade support 110 integral with a handle 112. The blade support 110 comprises a two third size planar face engaging surface 114 disposed at a downward angle to a handle axis. A bottom surface 116 begins at a lower edge 118 of the face engaging surface 114 and extends upward toward the handle 112 engaging the handle. A rear surface 120 extends vertically upward between the bottom surface and an upper edge of the face engaging surface. A pair of opposed slanted end surfaces 122,124 start from a point spaced from a center of the support member at the upper edge 121 to a point spaced above the lower edge 118. A blade 126 is imbedded in the support member 110 and includes a cutting edge 128 which projects downward and outward from the face engaging surface 114. The cutting edge 128 is parallel to and spaced slightly above the lower edge 118. The second embodiment 100 further comprises a longitudinal bore 130 formed centrally along the handle 112. A longitudinal slot 132 is formed in the handle communicating with the bore 130. An elongated rod 134 slidingly engages the bore 130, and a miniaturized razor 136 is formed integral with an upper end of the elongated rod 134.

A radial projection 138 extending outward from the elongated rod 134 slidingly engages the longitudinal slot 132. The radial projection contacting a lower end of the longitudinal slot 132 defines a retracted position for the miniaturized razor 136 wherein the razor 136 is below the blade support 110. In a deployed position, projection 138 engages an upper end of the slot 132 and the miniaturized razor 136 is extended above the blade support for use as a device for trimming beards and mustaches in close places.

An opening 140 is formed between the projection 138 and the rod 134, and the projection 138 is biased toward the side of the bore 130. To insert the rod 134 into the bore 130, the projection 138 is squeezed toward the center of the rod 134 filling the opening 140 and allowing the projection 138 to move radially inward and be inserted into the bore 130. When the projection 138 reaches the longitudinal slot 132 it is biased into the slot and is readily movable along the slot 132 to define the first and second positions for the miniaturized razor 136.

Figure 5:
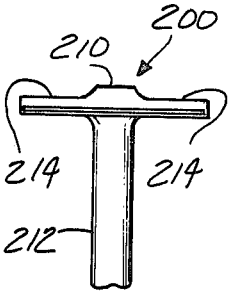
FIG. 5 illustrates a reduced size view of another embodiment of a head for the razor of FIG. 3.

Referring now to FIG. 5 of the drawing, wherein there is illustrated at 200 another embodiment of the present invention. A central portion 210 of the razor 200 is thickened to accommodate attachment of a handle 212. Outward of the handle the razor is thinned to narrow projections 214 to facilitate trimming around the users nose.

It is obvious to the skilled artisan that the configuration of the elements of the second embodiment 100 are ideally suited for making the elements from injection molded plastic, such as polyvinylchloride.

The simplicity of the second embodiment makes the manufacture of the safety razor so inexpensive that the second embodiment may be employed as a throw away device.

There has been described hereinabove a safety razor for conveniently trimming mustaches and beards including an inexpensive throw away embodiment.

Having thus described my invention what I claim is:

1. A safety razor for trimming mustaches and beards comprising:

a head, blade, and support including complementary thin tapered ends extending from an upper edge to a point proximate a lower edge;

a cutting edge of the blade projecting from the head parallel to spaced above and proximate the lower edge; and a miniature safety razor supported by a handle and movable between a first position wherein it is retracted into the head to a second position beyond deployed above the head for trimming beards and mustaches beneath the user's nose.

2. A safety razor including a handle for shaving an edge of beards and mustaches comprising:

a pair of opposed plastic blade supporting bodies comprising an elongated member including a planar face engaging wall extending downward and outward at an angle to an axis of the handle, a bottom wall beginning at a lower edge of the face engaging wall and extending upward from a rear edge of the bottom wall and spaced from the axis of the handle a distance to meet an upper edge of the face engaging wall, a vertical end wall defining one end of the member and a thin tapered end wall slanting from a point along the upper edge spaced from a center of the member to the lower edge defining another end of the member;

a blade imbedded in the plastic body, a cutting edge of the blade spaced up a distance and proximate the lower edge extending outward and downward from the face engaging wall and extending longitudinally from a point close to but short of the thin tapered end and the vertical end wall;

a downward extending collar integral with and supporting the members in a spaced apart manner to define a longitudinal channel between the rear walls, a threaded aperture formed in a lower end of the collar, a through opening concentric with the threaded bore aperture communicating with the longitudinal channel; and the handle including a threaded end to threadingly engage the threaded aperture.

3. The safety razor of claim 2 further comprising:

a central bore formed in the handle;

a rod including a threaded end slidingly engaging the bore;

a miniature razor including a miniature face engaging wall extending downward and outward from the rod, a bottom wall extending from a bottom edge of the miniature wall, a rear wall extending between the bottom wall and a top edge of the miniature face engaging wall, a pair of end walls defining the ends of the miniature razor, a threaded aperture formed in the bottom wall to threadingly engage the threaded end of the rod, and a miniature blade with a projecting cutting edge near the bottom edge;

the miniature razor being movable from a first position wherein it is retracted into the channel to a second position wherein it is deployed above the blade supporting bodies and usable to trim beards and mustaches.

4. The safety razor of claim 3 further comprising:

a slot formed longitudinally along the handle communicating with the bore;

a projection formed on the rod aligned with the slot and slidingly movable therealong; and wherein movement of the projection within the slot defines the first and second positions.

5. A safety razor and handle for shaving an edge of beards and mustaches comprising:

a blade support affixed to the handle comprising an elongated member including a planar face engaging surface disposed at a downward angle to a handle axis, a bottom surface beginning at a lower edge of the face engaging surface and extending upward toward the handle, a rear surface extending between the bottom surface and an upper edge of the face engaging surface, a pair of slanted end surfaces beginning at a point spaced from a center of the elongated member at the upper edge to a point spaced above the lower edge;

a blade imbedded in the support member including a cutting edge projecting downward and outward from the face engaging surface and spaced above the lower edge;

a longitudinal bore formed centrally along the handle;

a longitudinal slot communicating with the bore;

an elongated rod slidingly engaging the bore;

a miniaturized razor integral with an upper end of the elongated rod;

a radial projection extending outward from the elongated rod slidingly engaging the longitudinal slot; and wherein the miniaturized razor and rod are movable from a retracted position wherein the miniaturized razor is below the blade support to a deployed position wherein the miniaturized razor is extended above the blade support.

* * * * *